US005298671A

United States Patent [19]

Bliss

[11] Patent Number: 5,298,671

[45] Date of Patent: Mar. 29, 1994

[54] DATA COMPRESSION OF DECAYING MUSICAL INSTRUMENT SOUNDS FOR DIGITAL SAMPLING SYSTEM

[75] Inventor: Robert C. Bliss, Soquel, Calif.

[73] Assignee: E-mu Systems, Inc., Scotts Valley, Calif.

[21] Appl. No.: 893,942

[22] Filed: Jun. 4, 1992

Related U.S. Application Data

[63] Continuation of Ser. No. 465,733, Jan. 18, 1990, abandoned.

[51] Int. Cl.[5] ..... G10H 1/057; G10H 1/12

[52] U.S. Cl. ..... 84/603; 84/627; 84/661; 84/663; 84/DIG. 9

[58] Field of Search ..... 84/603, 622–625, 84/627, DIG. 9, DIG. 26, 661, 663

[56] References Cited

U.S. PATENT DOCUMENTS 4,916,996 4/1990 Suzuki et al. ..... 84/603

4,987,600 1/1991 Rossum ..... 84/603 X

*Primary Examiner*—Stanley J. Witkowski

*Attorney, Agent, or Firm*—Heller, Ehrman, White & McAuliffe

[57] ABSTRACT

Data compression apparatus and corresponding method used for decaying musical instrument sounds in a digital sampling instrument. The data compression technique according to the present invention provides for data compression of decaying musical instrument sounds that is designed to be stored in a small space, provide for adequate musical reproduction of the sound, and be reproduced using current data sample playback technology.

6 Claims, 2 Drawing Sheets

DATA COMPRESSION OF DECAYING MUSICAL INSTRUMENT SOUNDS FOR DIGITAL SAMPLING SYSTEM

This is a continuation of application Ser. No. 07/465,733, filed Jan. 18, 1990, abandoned.

BACKGROUND OF THE INVENTION

The present invention relates to data compression of decaying musical instrument sounds for a digital sampling system.

Using current digital sampling and playback techniques, it is very difficult to get significant amounts of data reduction when storing certain types of musical instrument sound data. The instruments exhibiting the most severe problems are those with wide transposition ranges and those with timbres that change over long periods of time. Typical musical instruments exhibiting these characteristics are the acoustic piano, guitars, and their relatives. Particularly difficult is the acoustic piano, owing to its wide range, long decay, and the use of multiple strings nearly in unison (hereafter "unison string") to produce a single tone.

While looping techniques for memory conservation are well known in the art, the aforementioned sounds still require large amounts of memory, even when looped. The decaying nature makes it difficult to perform a smooth, long loop, and short loops are too easily perceived. Also, loops that are placed too close to the attack portion of the note will be too harmonically rich to be interpreted as natural.

SUMMARY OF THE INVENTION

It is an object of the present invention to provide an improved data compression apparatus and method for decaying musical instrument sounds for digital sampling instrument.

It is a more particular object of the present invention to provide a method and apparatus of data compression for those sounds that is designed to be stored in a small space, provide for adequate musical reproduction of the sound, and to be reproduced using current day sample playback technology (linear data format).

Briefly, in one preferred embodiment of the present invention, there is provided an improved data compression method that converts a source of musical instrument sounds to a predetermined sample rate. The converted data is then compressed after the attack portion of the particular sound has ended.

The next step utilizes a time varying filter to provide a harmonically subdued area for looping as close as possible to the start of the sound. Next, a cross/fade looping step provides for blending information in the area previous to the loop into the loop area itself to hide the loop length. The present invention also includes the step of shifting of pointers and a second cross/fade loop to provide further improved data compression.

Other objects, features and advantages of the present invention will be set forth in part in the description which follows and in part become apparent to those skilled in the art upon examination of the following or may be learned by practice of the invention. The objects and advantages of the present invention may be realized and attained by means of the instrumentalities and combinations which are pointed out in the appended claims.

BRIEF DESCRIPTION OF THE DRAWINGS

The accompanying drawings which are incorporated in and form a part of this specification illustrate an embodiment of the invention and, together with the description, serve to explain the principles of the invention.

DETAILED DESCRIPTION OF THE DRAWINGS

Reference will now be made in detail to the preferred embodiment of the invention, an example of which is illustrated in the accompanying drawings. While the invention will be described in conjunction with the preferred embodiment, it will be understood that it is not intended to limit the invention to that embodiment. On the contrary, it is intended to cover alternatives, modifications and equivalents as may be included within the spirit and scope of the invention as defined by the appended claims.

Described herein is a method and apparatus for data compressing decaying and unison string musical instruments (e.g., piano) in preparation for storage and playback in a digitally sampled audio system. All techniques have been performed entirely in the digital domain, but some could be done through conversion back to analog, then processing and converting back to digital.

Sample Rate Conversin

Using techniques well known in the art, the sound can first be data compressed by sample rate converting to twice the upper frequency limit beyond which negligible energy is contained. This can be determined subjectively, but a practical reference point is that frequency which all frequencies above are greater than 60 dB below the amplitude of the fundamental frequency. A sample rate conversion to twice this upper cutoff frequency will maintain all information below the cutoff (the Nyquist frequency) while data reducing the sample file.

Compression

Figure 1:
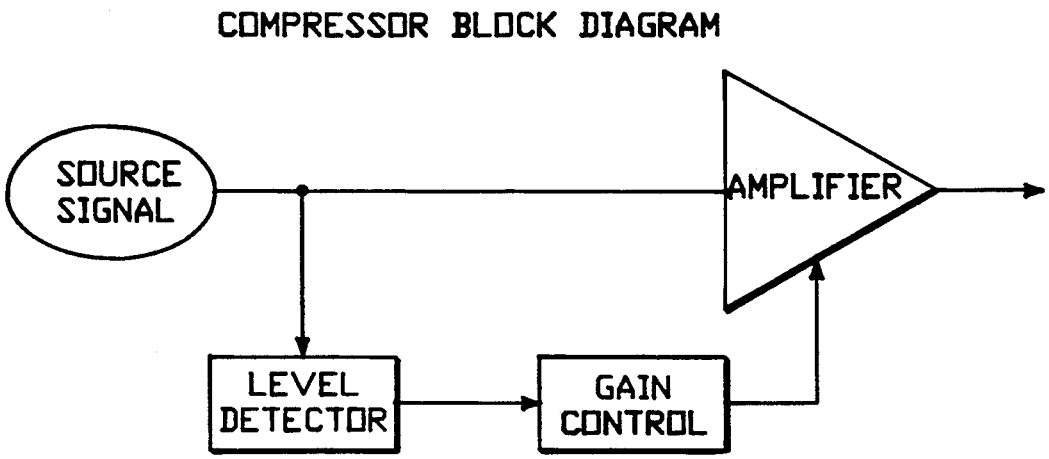
FIG. 1 depicts a compressor block diagram.
Figure 2:
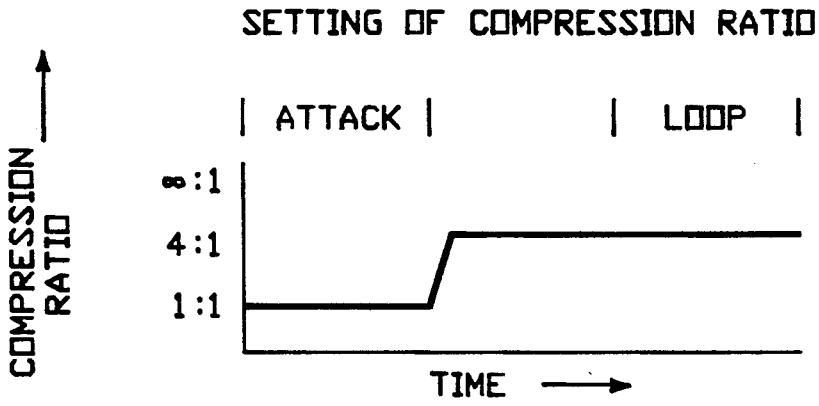
FIG. 2 depicts setting of a compression ratio.

In preparation for the looping, the signal is digitally compressed, that is, a form of automatic gain control is applied to keep the amplitude of the signal virtually constant (see FIG. 1) . While dynamic range compression itself is not new, the digital compressor allows precise control not afforded by more conventional (analog) means. As the attack portion of the sound is subjectively very important, the compression is applied starting at 0.5 to 1 second past the attack of the sound (see FIG. 2) to preserve the attack characteristics while flattening the amplitude in the area to be looped (the compression starts after the attack portion ends) . The exact compression ratio is not critical; ratios near 4:1 provide adequate results.

Filtering

Figure 3:
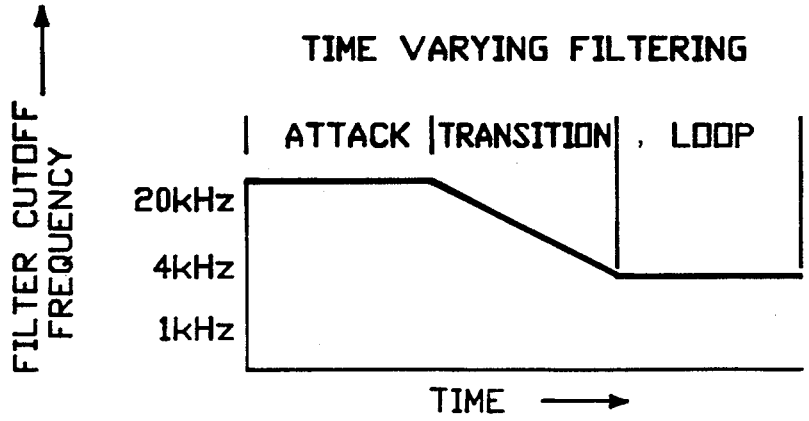
FIG. 3 depicts time varying filtering.

The natural characteristics of a struck or plucked string give a "bright" attack, i.e., more high frequency energy is present, followed by a decay of both amplitude and high frequency content. Also, in unison string instruments (e.g., piano) , the minor detuning of the strings causes dynamic frequency cancellations and reinforcements due to the shifting phase differences between the harmonics of the strings. This phasing effect draws the listeners' attention to the motion of the uppr harmonics and makes looping difficult. To make for better looping, the signal is subtly filtered with a time-varying lowpass filter. The attack (0.5 to 1 second) is once again left unchanged, with the cutoff frequency of the filter getting progressively lower towards the loop area. The cutoff frequency should then remain constant in the loop plateau to provide a stable area for looping (see FIG. 3) . Ultimate cutoff frequencies of between 1 and 2 KHz provide the desired response, with the exact value being determined subjectively to match the tonal characteristics of the source signal. This technique is used to effectively "hurry along" the natural decay process slightly, to provide a harmonically subdued area f or looping as close as possible to the start of the sound, conserving memory.

Cross/fade Looping

Figure 4:
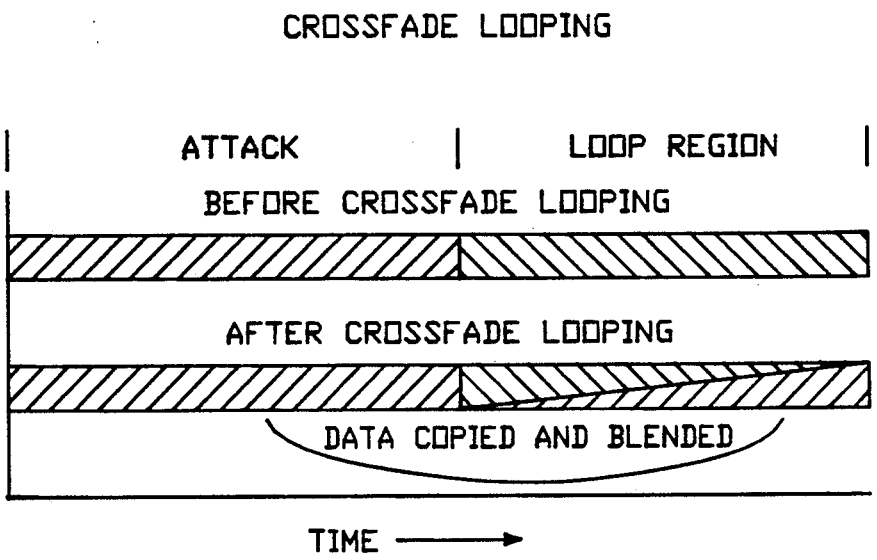
FIG. 4 depicts cross/fade looping.

Through techniques known in the art, a portion of the sound is looped to conserve memory. The designated loop area should be approximately one second in length. Shorter loops will be more easily perceived, and will be subjectively less pleasing. The loop area should be crossfade looped, that is, the information in the area previous to the loop should be blended into the loop area to hide the loop point (see FIG. 4). This not only hides the abrupt transition at the loop point, but due to the changing nature of the signal, recreates some of the harmonic phasing present in the original signal.

Shift of loop Pointers and second crossfade loon

Figure 5:
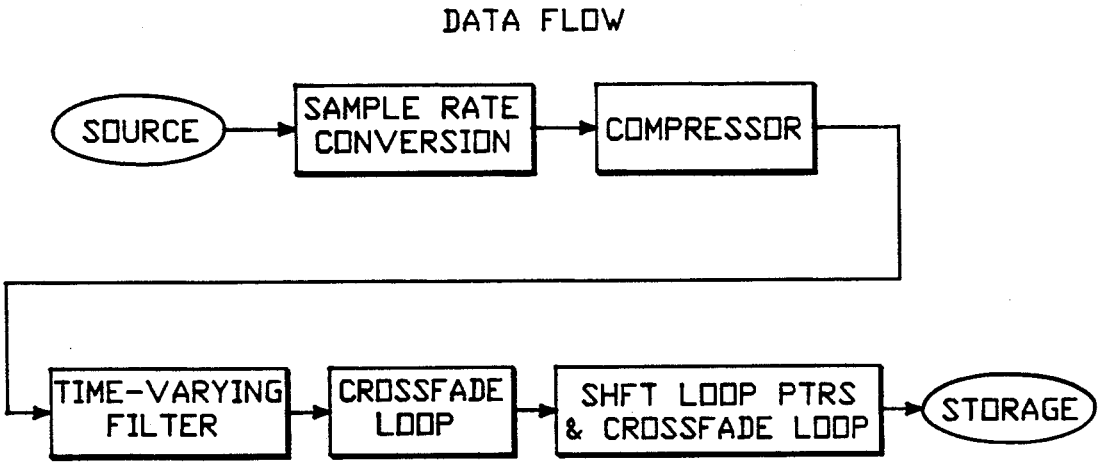
FIG. 5 depicts data flow according to the present invention.

In many cases, the loop will still be too easily perceived to be subjectively pleasing. While the amplitude in the loop may remain constant, a very pronounced repetitive timbral shift may destroy the illusion of natural continuation. By shifting the loop pointers and crossfade looping a second time (see FIG. 5), the obvious nature of the loop can be tamed. The loop end pointer should be shifted forward by one cycle of the source signal. When the signal is crossfade looped a second time, the loop area is modified by a comb filter effect inherent in the process of combining a signal with a delayed version of itself. The teeth of the comb are centered on the harmonics of the source signal, since we have chosen the delay period to be equal to the fundamental period of the source.

A data compression method and apparatus according to the present invention could be utilized, for example, in a digital sampling instrument such as one manufactured by E-mu Systems, Inc. of Scotts Valley, Calif., known as the EMULATOR III. Such a digital sampling instrument is manufactured by the same assignee as the present application.

The foregoing description of the preferred embodiment of the invention has been presented for purposes of illustration and description. It is not intended to be exhaustive or to limit the invention to the precise form disclosed, and many modifications and variations are possible in light of the above teaching. The preferred embodiment was chosen and described in order to best explain the principles of the invention and its practical applications to thereby enable others skilled in the art to best utilize the invention and various embodiments and with various modifications as are suited to the particular use contemplated. It is intended that the scope of the invention be defined only by the claims appended hereto.

What is claimed is:

1. In a data compression method for compression decaying musical instrument sounds for a digital sampling instrument wherein the musical sounds have an upper frequency limit and amplitude, the method comprising the steps of converting musical instrument sounds to a certain sample rate of approximately twice the upper frequency limit of the musical sounds to form sampled data including an attack portion, level compressing using automatic gain control the sampled data after the attack portion of the musical sound ends to form amplitude compressed data after the attack characteristics of said attack portion while flattening the amplitude of the remaining portion of said musical sounds filtering the level compressed data except said attack portion using a time varying filter having a predetermined cutoff frequency of between 1 KHz and 2 KHz to form harmonically compressed filtered data, and cross/fade looping the filtered data, including blending said filtered data before said looping to form blended filtered data.

2. The method as in claim 1 wherein said blended filtered data includes loop pointers and including the steps of shifting of said loop pointers and cross/fade looping a second time.

3. The method as in claim 2 including the step of storing the compressed data.

4. Data compression apparatus for compressing decaying musical instrument sounds for a digital sampling instrument wherein the musical sounds have an upper frequency limit and amplitude, the apparatus comprising means for converting musical instrument sounds to a certain sample rate of approximately twice the upper frequency limit of the musical sounds to form sampled data including an attack portion, means for level compressing using automatic gain control the sampled data after the attack portion of the musical sound ends to form amplitude compressed data after the attack characteristics of said attack portion while flattening the amplitude of the remaining portion of said musical sounds filtering the level compressed data except said attack portion using a time varying filter having a predetermined cutoff frequency of between 1 KHz and 2 KHz to form harmonically compressed filtered data, and cross/fade looping the filtered data, including blending said filtered data before said looping to form blended filtered data.

5. The apparatus as in claim 4 wherein said blended filtered data includes loop pointers and including means for shifting of said loop pointers and means for cross-/fade looping a second time.

6. The apparatus as in claim 5 including means for storing the compressed data.

* * * * *